US006744301B1

(12) United States Patent
Tschanz et al.

(10) Patent No.: US 6,744,301 B1
(45) Date of Patent: Jun. 1, 2004

(54) SYSTEM USING BODY-BIASED SLEEP TRANSISTORS TO REDUCE LEAKAGE POWER WHILE MINIMIZING PERFORMANCE PENALTIES AND NOISE

(75) Inventors: James W. Tschanz, Hillsboro, OR (US); Yibin Ye, Hillsboro, OR (US); Siva G. Narendra, Beaverton, OR (US); Vivek K. De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/707,528

(22) Filed: Nov. 7, 2000

(51) Int. Cl.[7] ..... G05F 3/02
(52) U.S. Cl. ..... 327/534; 327/537
(58) Field of Search ..... 327/530, 534, 327/537; 365/227, 229

(56) References Cited

U.S. PATENT DOCUMENTS 5,087,957 A * 2/1992 Ishimura et al. ..... 257/372
5,461,338 A * 10/1995 Hirayama et al. ..... 327/534
5,557,231 A * 9/1996 Yamaguchi et al. ..... 327/534
5,821,769 A * 10/1998 Douseki ..... 327/534
5,929,687 A * 7/1999 Yamauchi ..... 327/544
6,031,778 A * 2/2000 Makino et al. ..... 327/534
6,097,113 A * 8/2000 Teraoka et al. ..... 327/534
6,166,584 A 12/2000 De ..... 327/534
6,246,625 B1 * 6/2001 Yamagata et al. ..... 365/226
6,329,874 B1 12/2001 Ye et al. ..... 327/544

* cited by examiner

*Primary Examiner*—Terry D. Cunningham
(74) *Attorney, Agent, or Firm*—Schwegman, Lundberg, Woessner & Kluth, P.A.

(57) ABSTRACT

A system and method to reduce leakage power while minimizing performance penalties and noise is disclosed. In accordance with one embodiment of the invention, the system includes at least one sleep transistor operatively coupleable between a system power supply and at least one circuit powered by the system power supply to control the application of power to the circuit. The sleep transistor is also operatively coupleable to receive a sleep control signal to turn the sleep transistor on and off. A body bias voltage generator is operatively coupleable to a body of the at least one sleep transistor to substantially reduce leakage current when the sleep transistor is non-operational or idle and to improve the operational characteristics of the sleep transistor when the transistor is operational by reducing the performance penalty of the sleep transistor and by reducing impact of noise on the circuit and other devices.

17 Claims, 4 Drawing Sheets

SYSTEM USING BODY-BIASED SLEEP TRANSISTORS TO REDUCE LEAKAGE POWER WHILE MINIMIZING PERFORMANCE PENALTIES AND NOISE

FIELD OF THE INVENTION

The present invention relates generally to integrated circuits and the like, and more particularly to a system that uses body-biased sleep transistors to reduce leakage power and to minimize performance penalties and noise in integrated circuits and the like.

BACKGROUND INFORMATION

Ever increasing performance demands are being placed on computer circuits, microprocessors, application specific integrated circuits (ASICs) and other ICs and VLSICs. ASICs, ICs and VLSICs are being required to operate at continually increasing clock speeds to perform more operations in a shorter period of time. To provide these faster operating speeds, circuits and processes are being designed to operate at lower threshold voltages. With the lower threshold voltages, the flow of leakage current from a system power supply to a circuit supplied by the system power supply can increase. The leakage current can therefore result in a significant amount of power consumption in a circuit. This can be critical in mobile, battery powered electronic devices, such as cellular telephones, mobile radios, laptop computers and handheld computing devices and the like, where the ability to operate for extended periods of time on battery power is of primary importance to users.

One arrangement for reducing leakage current and power consumption in a circuit is through the use of sleep transistors that can have either high or low threshold voltages. This arrangement is described in U.S. patent application Ser. No. 09/151,827 by Ye et al., file Sep. 11, 1998 and entitled "A Method and Apparatus for Reducing Standby Leakage Current Using a Leakage Control Transistor That Receives Boosted Gate Drive During an Active Mode" and assigned to the same assignee as the present application. When the sleep transistor is active or turned on, the system power supply is supplying current to the circuit. When the sleep transistor is idle or turned off, the intent is that no current is supplied to the circuit. However, depending upon the characteristics of the sleep transistor and the circuit or load, there will be some leakage current through the sleep transistor and power consumption in the circuit. There will be some voltage drop across the sleep transistor and the circuit effectively has a Air small voltage supply that can cause a performance penalty in terms of operational delays and noise interference. The magnitude of this performance penalty, as well as the degree of leakage power reduction will depend upon the size and operating characteristics of the sleep transistor. Larger sleep transistors typically provide a smaller leakage reduction factor but also a smaller impact on performance. In other words, there is a trade-off between performance impact and leakage reduction. Large sleep transistors minimize the performance impact, but take up a larger amount of area and do not provide as much leakage reduction. Smaller sleep transistors reduce leakage by a larger amount or factor but also suffer some impact to performance.

Accordingly, for all of the reasons discussed above, and for other reasons that will become apparent upon reading and understanding the present specification, there is a need for a system and method to reduce leakage current and power consumption in a circuit on an IC or other electronic device while minimizing the impact on performance and the generation of noise that can adversely affect the operation of the circuit or other components on the IC.

DESCRIPTION OF THE EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
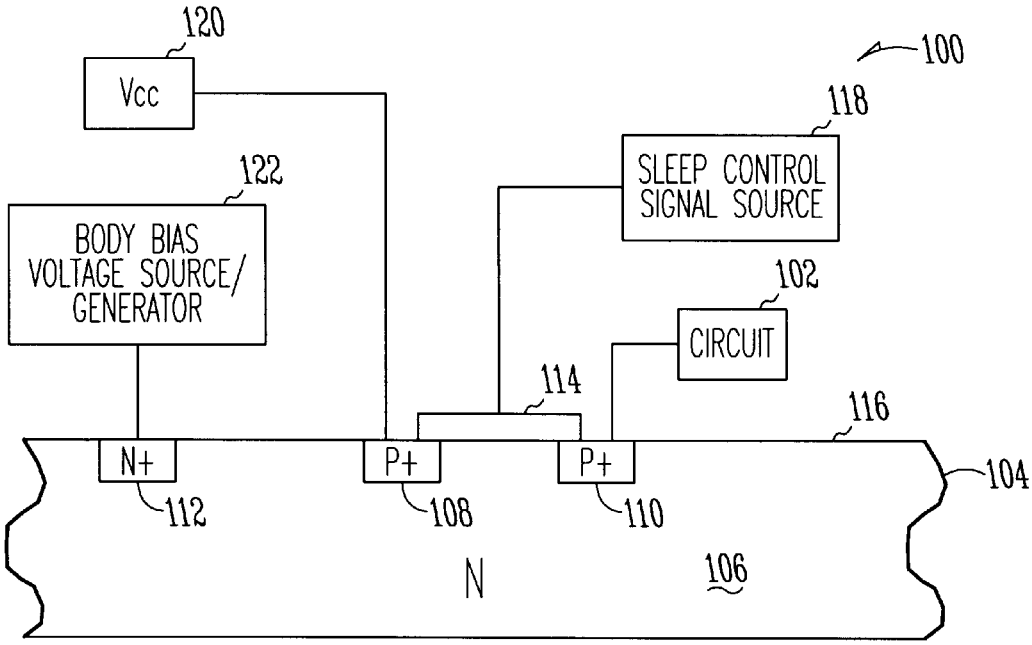
FIG. 1 is a block schematic diagram of a system for reducing leakage power while minimizing performance penalties and noise including a crosssectional view of a sleep transistor in accordance with the present invention.

Referring initially to FIG. 1, a system 100 for reducing leakage current and power consumption in a circuit 102 is shown in accordance with one embodiment of the present invention. The circuit 102 may be any circuit having a particular purpose or function and may be a component in a larger device. The system 100 includes an electronic switching device or sleep transistor 104. The sleep transistor 104 shown in FIG. 1 is a P-channel metal oxide semiconductor (PMOS) transistor; although an N-channel metal oxide semiconductor (NMOS) transistor or other type switching device could be used as well. The PMOS sleep transistor 104 includes an N well or substrate 106 with a pair of P+ regions 108 and 10 formed therein and an N+ region 112. A gate contact 114 is disposed on a thin layer of insulating oxide (not shown in FIG. 1) over a surface 116 of the N substrate 106 and overlying at least portions of P+ regions 108 and 110. The gate contact 114 is operatively connected to receive a predetermined sleep control signal from a sleep control signal source 118, such as a processor or the like. The predetermined sleep control signal will turn the sleep transistor 104 on and off. For example, a predetermined sleep control signal that is a logic low signal may turn the PMOS sleep transistor 104 on. A predetermined sleep control signal that is a logic high may turn the PMOS sleep transistor 104 off. Similarly, if an NMOS sleep transistor were substituted for the PMOS sleep transistor 104, a logic high sleep control signal would turn the sleep transistor on and a logic low sleep control signal generated by the sleep control signal source 118 would turn an NMOS sleep control transistor off.

The sleep transistor 104 is operatively connected between a system power supply 120 (Vcc) and the circuit 102. The P+ region 108 of the sleep transistor 104 is electrically connected to the system power supply 120 (Vcc) and the other P+ region 110 is electrically connected to the circuit 102. Accordingly, electric current will be supplied or switched through the sleep transistor 104 to the circuit 102 when the sleep transistor is in an active mode or operational in response to receiving the appropriate predetermined sleep control signal from the sleep control signal source 118. The sleep transistor 104 will be turned off or in an idle or standby mode in response to receiving the appropriate predetermined sleep control signal to turn off the sleep transistor 104 and open the conductive path between the system supply voltage 120 and the circuit 102. However, depending upon the size and operational characteristics of the sleep transistor 104 and the circuit 102, there will be some amount of leakage current flowing through the sleep transistor 104 and therefore power consumed by the circuit 102 when the sleep transistor 104 is in the idle mode.

In accordance with the present invention, a body bias voltage source/generator 122 may be electrically connected to the N+ region 112 to apply an appropriate body bias potential of a selected polarity and voltage level or amplitude to the sleep transistor 104 to enhance or alter the operation of the sleep transistor 104 in the active and idle modes as will be discussed in more detail with reference to FIG. 2.

Figure 2:
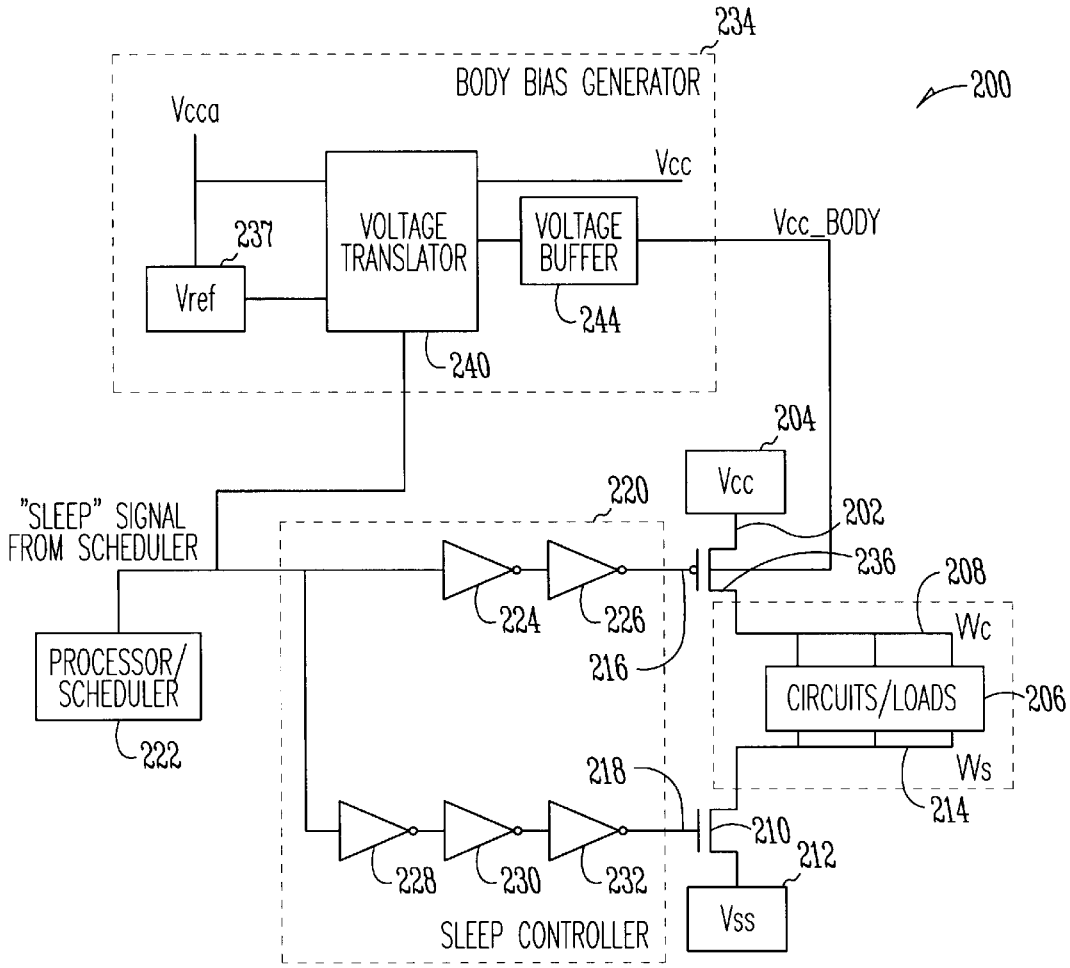
FIG. 2 is a block schematic diagram of a system for reducing leakage power while minimizing performance penalties and noise in accordance with the present invention.

FIG. 2 illustrates a block schematic diagram of a system 200 for reducing leakage power while minimizing performance penalties and noise in accordance with a further embodiment of the present invention. The system 200 includes a first sleep transistor 202 operatively connected between a system power supply 204 (Vcc) and at least one circuit or circuits 206 to control the application of power from the power supply 204 to the at least one circuit 206. The first sleep transistor 202 may be connected to a first virtual power rail (VVC) 208 that distributes power to multiple different circuits or loads 206. The system 200 also includes a second sleep transistor 210 operatively connected between a second system power supply 212 (Vss) and the at least one circuit or circuits 206. The second sleep transistor 210 may be electrically connected to a second virtual power rail (VVS) 214 for the distribution of power to the multiple circuits or loads 206.

The first and second sleep transistors 202 and 210 are preferably complementary devices. For example, the first sleep transistor 202 may be a PMOS transistor or the like and the second sleep transistor 210 may be an NMOS transistor or the like.

The first and second sleep transistors 202 and 210 each have respective gate terminals 216 and 218 that are operatively connected to receive a predetermined sleep transistor control signal from a sleep controller 220. The sleep controller 220 may be connected to a processor 222, scheduler or the like for generating the predetermined sleep control signals according to a selected schedule of operation. One example of sleep controller 220 shown in FIG. 2 includes a pair of series connected inverters 224 and 226 electrically connected between the processor 222 and the gate 216 of the first sleep transistor 202 and may further include three series connected inverters 228, 230 and 232 electrically connected between the processor 222 and the gate 218 of the second sleep transistor 210. The sleep controller 220 may basically be any circuit that presents the appropriate, predetermined polarity of the logic control signal to the sleep transistors 202 and 210 for proper operation thereof.

In accordance with the present invention, a body bias voltage source or L generator 234 is operatively connected to a body 236 of the sleep transistor 202. The voltage generator 234 is in effect electrically connected to an N+ region (similar to N+ region 112 in FIG. 1) of the sleep transistor 202. One example of a body bias generator 234 is shown in FIG. 2. In the example of FIG. 2, the body bias generator 234 includes a reference voltage source 237 connected to a voltage source Vcca. The reference voltage source 237 is connected to a voltage translator 240. The voltage source Vcca and the system power supply 204 Vcc are also both electrically connected to the voltage translator 240. The processor 222 is also electrically connected to the voltage translator 240 to control the voltage translator 240 to selectively apply the proper polarity bias voltage at a predetermined level or amplitude to the body 236 of the sleep transistor 202 depending upon the operational mode of the sleep transistor 202. The voltage translator 240 is electrically connected to a voltage buffer 244 to provide the required drive current to the body 236 of the sleep transistor 202.

The body bias generator 234 may also be any stable voltage source capable of generating a selected voltage level and polarity for application to the body 236 of the sleep transistor 202. The processor 222 will control the voltage level selected and the polarity of the voltage according to the operational mode of the sleep transistor 202.

In operation, the sleep transistor 202 is operational and in an active mode or state in response to being activated by a predetermined sleep control signal from the processor 222. For the sleep transistor 202 being a PMOS transistor, the predetermined sleep control signal may be a logic low sleep control signal or a negative voltage control signal applied to the gate 216 to turn on the PMOS sleep transistor 202 to apply power from the system power supply 204 to the circuit or circuits 206. Similarly, if the sleep transistor 202 was an NMOS transistor, the predetermined sleep control signal to activate or turn on the transistor 202 may be a logic high sleep control signal or a positive voltage control signal.

With the sleep transistor 202 in the operational or active mode, the processor 222 may then control the body bias generator 234 to apply a forward body bias voltage at a predetermined voltage level to the body 236 of the sleep transistor 202 to alter or enhance the operational characteristics of the sleep control transistor 202. Accordingly, the predetermined voltage level of the forward body biased voltage may be chosen to provide a selected reduction in the effective threshold voltage of the sleep transistor 202; a selected increase in the transistor drive current (Vcc/Vt ratio); reduced short channel effects; a selected reduction in voltage drop across the sleep transistor 202 to cause faster operation or switching of the transistor 202 and selected reduction in noise interference on the virtual power rails 208 and 214 and in the circuits 206. A forward body bias voltage is applied to the sleep transistor 202 so that the body 236 of the transistor 202 will preferably be at a voltage potential lower than that of the system voltage supply Vcc 204 when the sleep transistor 202 is in the active mode.

While a predetermined sleep control signal is applied to the gate 216 of PMOS sleep transistor 202, the sleep controller 220 will cause a complementary predetermined sleep control signal to be applied to the gate 218 of the second NMOS sleep transistor 210 to turn on the second sleep transistor 210. The second sleep transistor 210 will then be in an operational or active mode to apply the second system power supply Vss 212 to the virtual power rails VVS 214 and to the circuits 206.

In an idle or standby mode, the first PMOS sleep transistor 202 is turned off in response to another predetermined sleep control signal from the processor 222. The other predetermined sleep control signal may be a logic high sleep control signal or a positive voltage control signal applied to the gate 216 of the PMOS sleep transistor 202 to turn off the sleep transistor 202. (The polarities for an NMOS sleep transistor would be the opposite of those for the PMOS sleep transistor 202).

Figure 3:
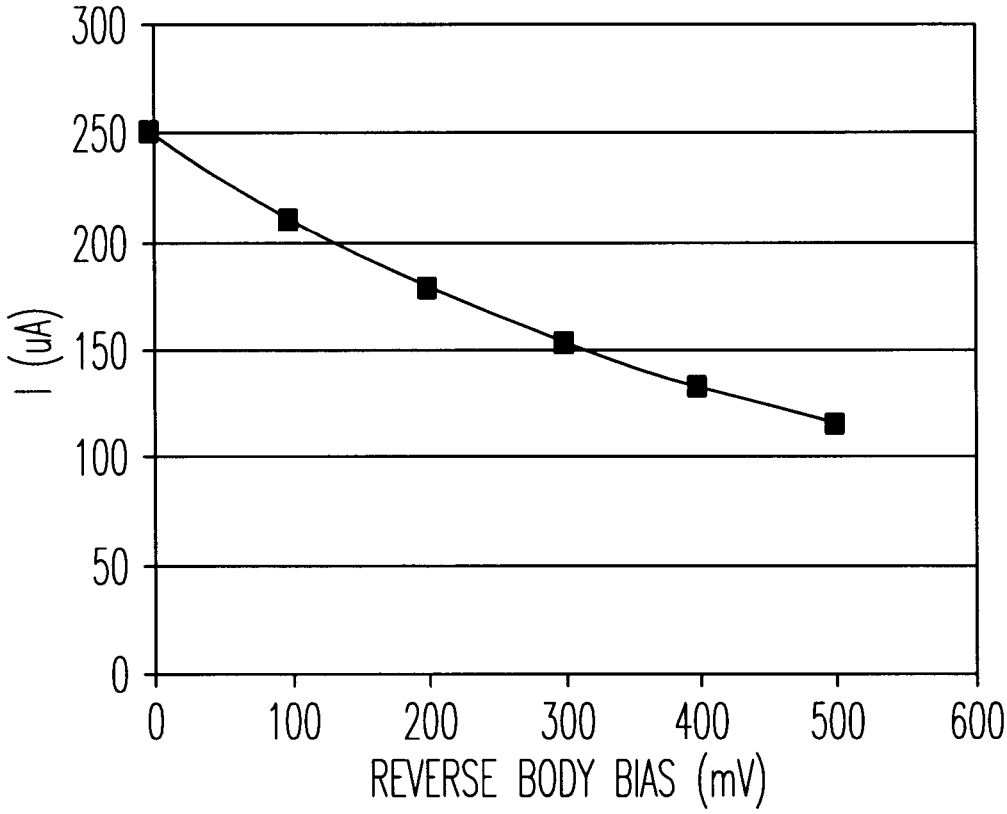
FIG. 3 is a graph of leakage current versus reverse body bias voltage for the systems shown in FIGS. 1 and 2.

With the sleep transistor 202 turned off and in the idle mode to substantially disconnect the system power supply 204 from the circuits 206, the processor 222 may control the body bias generator 234 to selectively apply either a zero body bias voltage or a reverse body bias voltage at a predetermined level to the body 236 of the first sleep transistor 202 to substantially reduce the flow of leakage current through the first sleep transistor 202. The body bias voltage generator 234 is therefore controllable to apply a predetermined reverse body bias voltage to the first sleep transistor 202 to cause the body 236 of the transistor 202 to be at a higher voltage potential than the system power supply Vcc 204 to reduce leakage current. The level of the reverse body voltage may be controlled or selected to provide a selected reduction in the leakage current. FIG. 3 is a graph of the relationship between leakage current and the voltage level of the reverse body bias voltage. FIG. 3 illustrates that the leakage current is reduced as a function of increasing reverse bias voltage.

Figure 4:
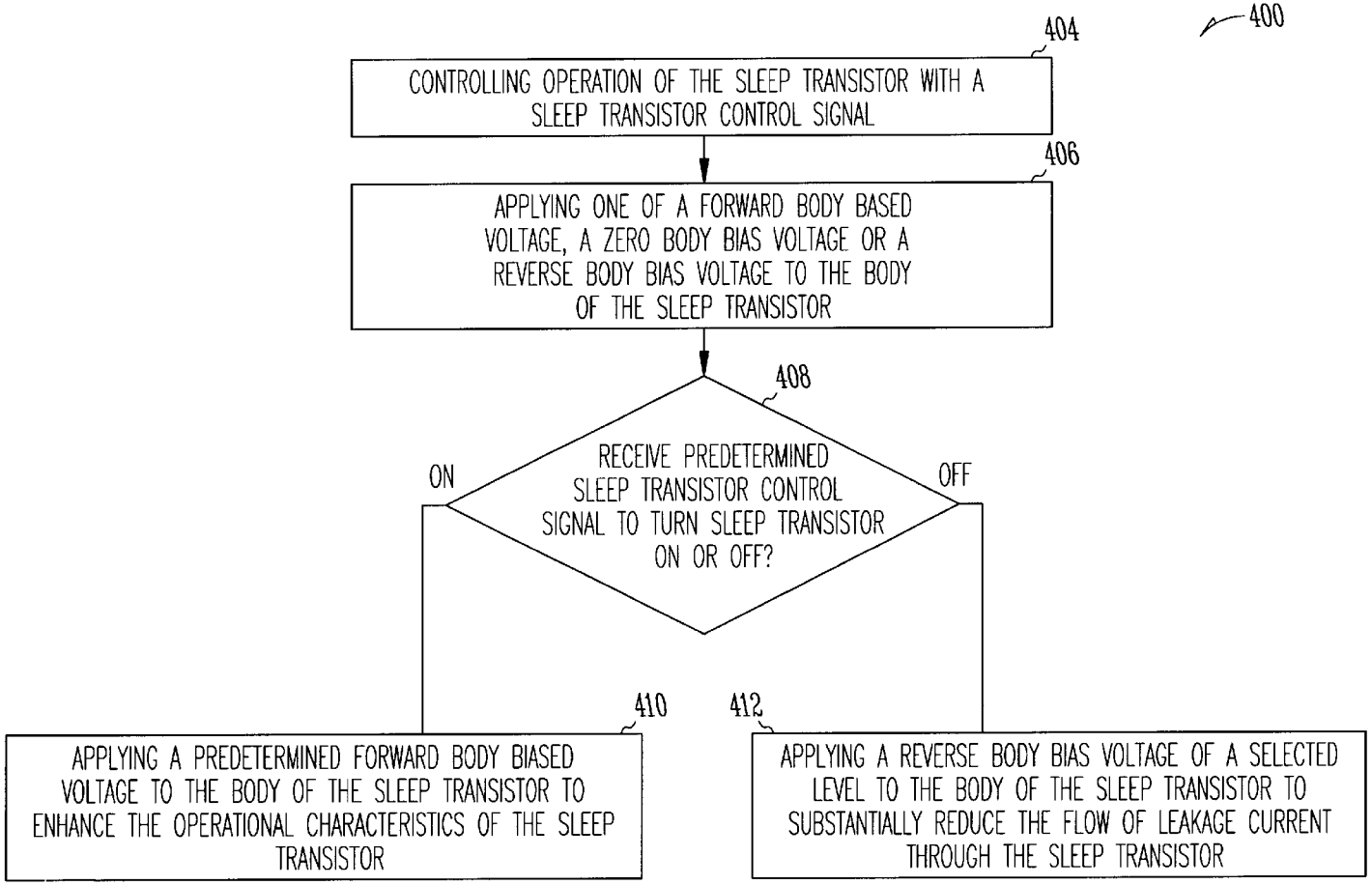
FIG. 4 is a flow chart of a method to reduce leakage power while minimizing performance penalties and noise in accordance with the present invention.

FIG. 4 is a flow chart 400 of a method to reduce leakage power while minimizing performance penalties and noise in accordance with the present invention. In step 404, the operation of the sleep transistor 202 (FIG. 2) is controlled by a sleep transistor control signal. As previously discussed, the sleep control signal may be generated by a sleep control signal source 118 (FIG. 1) or by a processor or scheduler 222 and the proper polarity may be controlled by a sleep controller 220 (FIG. 2). In step 406, a body bias voltage source or generator 234 is connected to the body 236 of the sleep transistor 202 to apply one of a forward body biased voltage, a zero body bias voltage or a reverse body bias voltage to alter or enhance the operational characteristics of the sleep transistor 202 in the active and idle modes. In step 408, a determination is made whether the sleep control signal received is to turn the sleep transistor 104, 202 on or off. If the sleep control signal turns the sleep transistor 202 on, the method goes to step 410 where a predetermined forward body bias voltage is applied to the body 236 of the sleep transistor 202 to enhance the operational characteristics of the sleep transistor 202 in the active mode. If the sleep control signal turns the sleep transistor 202 off, the method goes to step 412 where a reverse body bias voltage of a selected level is applied to the body 236 of the sleep transistor 202 to substantially reduce the flow of leakage current through the sleep transistor 202 in the idle mode.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is intended that this invention be limited only by the claims and the equivalents thereof.

What is claimed is:

1. A system, comprising:

a first sleep transistor to control the application of power to at least one circuit and to receive a sleep transistor control signal;

a second sleep transistor to control application of power to the at least one circuit and to receive a complement of the sleep transistor control signal; and a region formed in a body of the first sleep transistor and adapted to receive a body bias voltage to alter operational characteristics of the first sleep transistor, wherein the first sleep transistor is turned off in response to the absence of a sleep control signal or a sleep control signal that turns off the first sleep transistor and wherein the region to selectively receive a reverse biased voltage to substantially reduce power consumption due to leakage current drawn by the at least one circuit.

2. The system of claim 1, wherein the leakage current is inversely proportional to the reverse body bias voltage applied to the first sleep transistor.

3. The system of claim 1, wherein the first transistor is a P channel metal oxide semiconductor (PMOS) transistor and the second transistor is an N channel metal oxide semiconductor (NMOS) transistor.

4. The system of claim 1, further comprising a body bias voltage generator adapted to provide the body bias voltage and wherein the body bias voltage generator comprises:

a voltage translator coupled to a reference voltage and a supply voltage; and a voltage buffer coupled to the voltage translator.

5. The system of claim 1, further comprising a sleep controller coupled to the first and second sleep transistors.

6. A method, comprising:

controlling the operation of a switching device to control the application of power to a circuit;

applying one of a forward body bias voltage, a zero body bias voltage or a reverse body bias voltage to a region formed in a body of the switching device to enhance the operating characteristics of the switching device;

disconnecting the power from the circuit in response to the switching device receiving a predetermined control signal; and applying a predetermined reverse body bias voltage to the region to substantially reduce the flow of any leakage current through the switching device.

7. The method of claim 6, further comprising:

connecting the power to the circuit in response to the switching device receiving a predetermined sleep control signal; and applying a predetermined forward body biased voltage to the region to enhance the operational characteristics of the switching device and to substantially reduce a performance penalty of the switching device and substantially reduce adverse noise effects on the circuit.

8. The method of claim 6, further comprising:

reducing the effective threshold voltage for operation of the switching device;

increasing a current drive of the switching device;

decreasing a voltage drop across the switching device; and increasing a speed of operation of the switching device and the circuit, all by applying a predetermined forward body biased voltage level to the switching device.

9. The method of claim 8, wherein the predetermined forward body biased voltage is applied so that the body of the switching device is at a lower voltage potential than a power supply voltage.

10. The method of claim 6, further comprising:

controlling the operation of another switching device with a control signal to turn the other snitching device on and off.

11. The method of claim 10, wherein the one switching device is a P channel metal oxide semiconductor (PMOS) sleep transistor and the other switching device is an N channel metal oxide semiconductor (NMOS) sleep transistor.

12. The method of claim 10, wherein the one switching device is an N channel metal oxide semiconductor (NMOS)

sleep transistor and the other switching device is a P channel metal oxide semiconductor (PMOS) sleep transistor.

13. A method, comprising:

controlling the operation of a switching device to control the application of power to a circuit;

applying one of a forward body bias voltage, a zero body bias voltage or a reverse body bias voltage to a region formed in a body of the switching device to enhance the operating characteristics of the switching device;

disconnecting the power from the circuit in response to the switching device receiving a predetermined control signal; and applying a predetermined reverse body bias voltage to the region to cause the body of the switching device to be at a higher voltage potential than a power supply voltage.

14. The method of claim 13, further comprising connecting a body bias voltage to the region to apply the forward body bias voltage, the zero body bias voltage or the reverse body bias voltage.

15. The method of claim 13, further comprising connecting a processor to a body bias voltage generator to control the body bias voltage applicable to the one switching device.

16. The method of claim 13, further comprising providing a processor to generate control signals to control operation of the switching device to either connect the power to the circuit or to disconnect the power from the circuit.

17. A method, comprising:

controlling the operation of a switching device to control the application of power to a circuit;

applying one of a forward body bias voltage, a zero body bias voltage or a reverse body bias voltage to a region formed in a body of the switching device to enhance the operating characteristics of the switching device;

connecting the power to the circuit in response to the switching device receiving a predetermined sleep control signal; and applying a predetermined forward body biased voltage to the region to enhance the operational characteristics of the switching device and to substantially reduce a performance penalty of the switching device and substantially reduce adverse noise effects on the circuit.

* * * * *

UNITED STATES PATENT AND TRADEMARK OFFICE

CERTIFICATE OF CORRECTION

PATENT NO. : 6,744,301 B1
DATED : June 1, 2004
INVENTOR(S) : Tschanz et al.

It is certified that error appears in the above-identified patent and that said Letters Patent is hereby corrected as shown below:

Column 6,
Line 59, delete “snitching” and insert -- switching --, therefor.

Signed and Sealed this

Fifteenth Day of November, 2005

JON W. DUDAS
*Director of the United States Patent and Trademark Office*